United States Patent [19]

Shrock

[11] Patent Number: 5,045,841

[45] Date of Patent: Sep. 3, 1991

[54] ELECTRONIC THUMBWHEEL SWITCH

[76] Inventor: Richard A. Shrock, c/o American Control Technology, 825 Village Quarter Rd., West Dundee, Ill. 60118

[21] Appl. No.: 595,682

[22] Filed: Oct. 4, 1990

Related U.S. Application Data

[63] Continuation of Ser. No. 285,513, Dec. 16, 1988, abandoned.

[51] Int. Cl.[5] ..... G09G 3/04

[52] U.S. Cl. ..... 340/706; 340/752; 340/760; 340/815.13

[58] Field of Search ..... 340/815.12, 815.13, 340/815.14, 815.04, 825.36; 377/115, 116, 117, 38

[56] References Cited

U.S. PATENT DOCUMENTS

| | | | |
|---|---|---|---|
| 3,651,463 | 3/1972 | Rawson et al. | 341/22 |
| 4,112,429 | 9/1978 | Tsuha et al. | 340/756 |
| 4,158,767 | 6/1979 | Long | 377/52 |
| 4,318,095 | 3/1982 | Fukuoka | 340/706 |
| 4,488,148 | 12/1984 | Kuciera | 340/711 |
| 4,491,827 | 1/1985 | Sugiura et al. | 340/711 |
| 4,530,108 | 7/1985 | Wilmsmeyer | 377/111 |
| 4,549,094 | 10/1985 | Floyd | 341/24 |
| 4,631,525 | 12/1986 | Serravalle, Jr. | 340/712 |
| 4,759,044 | 6/1988 | Hövelmann | 377/111 |

OTHER PUBLICATIONS

"BCD Switch/Display Units Mate to Host Systems", *Electronic Design,* May 28, 1987 (Advertisement).

Module product brochure-Digitran, A Division of XCEL Corp. 1986.

"Compact Version of New Coding Display System, CS102", by Gratz and Meulemeester, Components Report XIII (1978) No. 3.

*Primary Examiner*—Jeffery A. Brier

*Attorney, Agent, or Firm*—Wood, Phillips, Mason, Recktenwald & Van Santen

[57] ABSTRACT

An electronic thumbwheel switch includes an up/down counter for storing a thumbwheel count value. A display device is coupled to the up/down counter for displaying the count value. A manual input switch is coupled to the up/down counter for selecting a desired count value to be displayed on the display device. An interface circuit is coupled to the up/down counter and includes a data bus buffer for developing an output representing the stored numeric value and a logic circuit and data bus for loading a numeric value received from an external source into the up/down counter for display on the display device.

18 Claims, 5 Drawing Sheets

ELECTRONIC THUMBWHEEL SWITCH

This application is a continuation, of application Ser. No. 285,513, filed Dec. 16, 1988, now abandoned.

BACKGROUND OF THE INVENTION

1. Field of the Invention

This invention relates to thumbwheel switches, and more particularly, to an electronic thumbwheel switch operable under supervisory control.

2. Background of the Invention

Process control systems and other industrial control systems typically utilize numeric values as set points and as input parameters, for example, to control the overall system. Therefore, any apparatus used for determining such numeric values is of major importance to both the system end-user and the system designer. Criteria involved in the selection of such apparatus include cost, ease of use, reliability and flexibility.

One known device for generating a numeric input value comprises a thumbwheel switch. Such a known thumbwheel switch comprises a numbered cylinder having a user rotatable drive mechanism for selecting the number for display. Particularly, the cylinder may be rotated by a finger, such as a thumb, and thus the name thumbwheel. The rotational position of the cylinder controls a series of switch contacts which are electrically coupled to a plurality of switch terminals. These switch terminals can be connected to an external control device which senses the status of the switches to determine the displayed numeric value.

The use of such prior electro-mechanical thumbwheel switches has proven costly and cumbersome to implement in an overall control system. Specifically, each thumbwheel switch typically requires two or three connectors, necessary cable, pullup resistors and multiplexer logic to determine the numeric value. Also, such thumbwheel switches are inflexible in their application and do not lend themselves to microprocessor and microcontroller based systems. In fact, such devices are intended more specifically for use in hard wired systems.

Prior control systems often required the use of numerous thumbwheel switches, with each switch serving a dedicated function. The requirement for such a vast number of switches adds significant cost not only for the actual hardware, but the extra switches require additional panel space as well as labor costs for wiring the same to the control devices.

The present invention is intended to overcome one or more of the problems as set forth above.

SUMMARY OF THE INVENTION

In accordance with the present invention, a thumbwheel is provided with a circuit for permitting supervisory control of the thumbwheel count.

Broadly, there is disclosed herein an electronic thumbwheel including means for storing a thumbwheel numeric value. A display device is coupled to the storing means for displaying the numeric value. A manual input means is coupled to the storing means for selecting a desired numeric value to be displayed on the display device. An interface circuit is coupled to the storing means and includes means for developing an output representing the stored numeric value and means for loading a numeric value received from an external source into said storing means for display on said display device.

Specifically, the thumbwheel comprises a single LSI chip in a compact dual-in-line package. According to the invention, the thumbwheel switch contains a single-character alpha-numeric liquid crystal display, up and down pushbuttons, and a low-power CMOS integrated circuit. The thumbwheel switch communicates with a host processor via a parallel RAM-like interface. In a local mode, the liquid crystal display displays a value stored in an up/down counter. The value in the counter is determined responsive to actuation of the up pushbutton or the down pushbutton. Particularly, each occurrence that the up pushbutton is depressed, the counter increments by one. Conversely, if the down pushbutton is depressed, then the counter value is decremented. The value of the up/down counter is also transmitted by way of a buffer circuit to the parallel interface. Under supervisory control, a read/write logic circuit is operable to command the up/down counter to preload with a value present at the four-bit parallel interface received from a host processor, or other external device.

It is a feature of the present invention that the thumbwheel is provided with a filter logic circuit for minimizing switch bounce from the up and down pushbuttons.

In accordance with another aspect of the invention, the heel selectively displays a character representing a heel count or an alternate substitute display character.

Specifically, according to this other aspect of the invention, a thumbwheel as described above further includes a character latch circuit which stores an ASCII character received from the parallel interface. A data selector circuit is operable to selectively couple either the up/down counter or the character latch to the display.

Further features and advantages of the invention will readily be apparent from the description and the drawings.

DETAILED DESCRIPTION OF THE INVENTION

Figure 1:
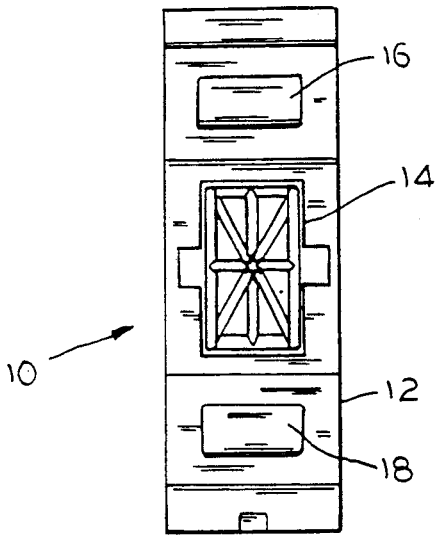
FIG. 1 is a perspective view of an electronic thumbwheel switch according to the invention.

With reference to FIG. 1, a solid-state, electronic thumbwheel switch 10 according to the invention is illustrated. In its simplest form, the thumbwheel switch 10 includes a housing 12, a character display 14, an up pushbutton 16 and a down pushbutton 18. The display 14 displays a character determined in accordance with actuation of the pushbuttons 16 and 18. For example, in a basic operation, the character display 14 selectively displays either a decimal value or a hexadecimal value which can be incremented by depressing the up pushbutton 16 or decremented by depressing the down pushbutton 18.

Figure 2:
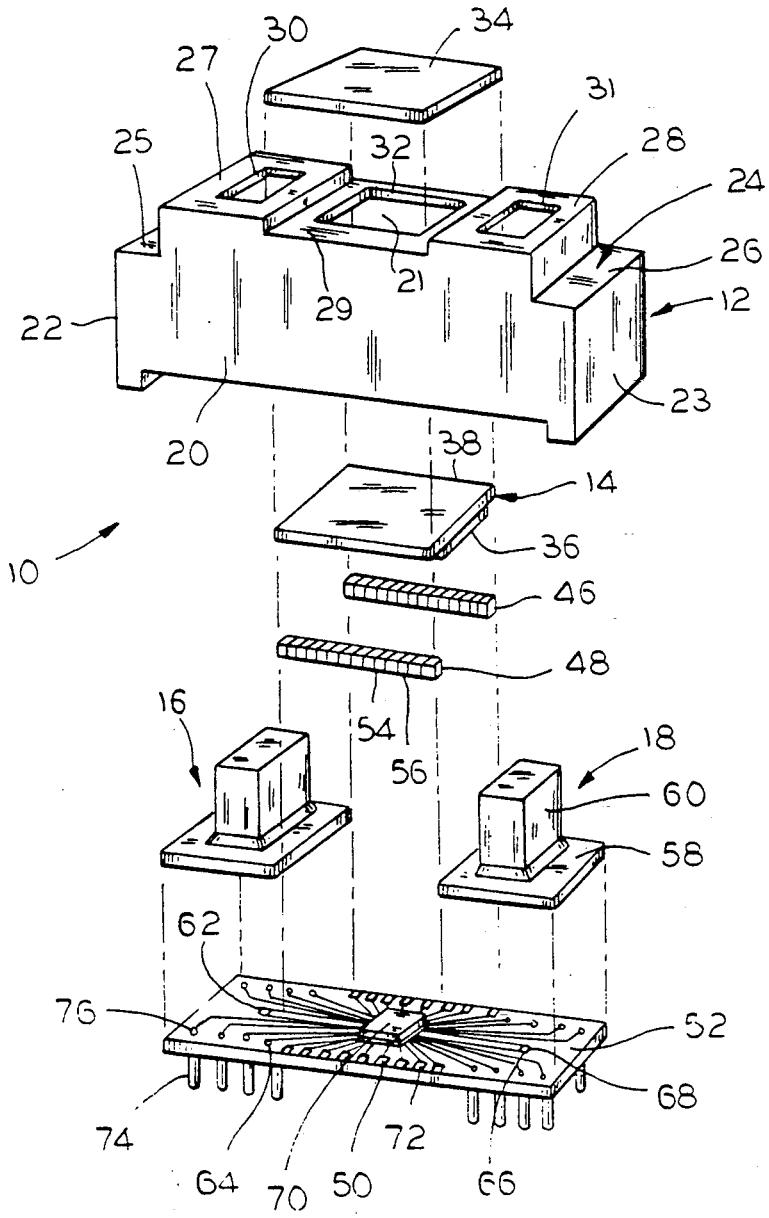
FIG. 2 is an exploded view of the thumbwheel switch of FIG. 1.

Referring also to FIG. 2, the housing 12 includes opposite side walls 20 and 21 joined by opposite end walls 22 and 23. The walls 20–23 are further joined by a terraced top wall 24. Specifically, the top wall 24 includes relatively low profile end sections 25 and 26 joined to the respective end walls 22 and 23, relatively high profile intermediate sections 27 and 28 immediately adjacent the respective end sections 25 and 26, and a medium profile central section 29 between the high profile sections 27 and 28. Rectangular-shaped pushbutton openings 30 and 31 are provided through the high profile sections 27 and 28, respectively. A square-shaped display opening 32 is provided through the central section 29.

A lens 34 is adhered by any known means to the top wall central section 29. The lens 34 overlies the display opening 32 and is formed of a transparent material to protect the display 14 and yet permit the displayed character to be visible.

Figure 3:
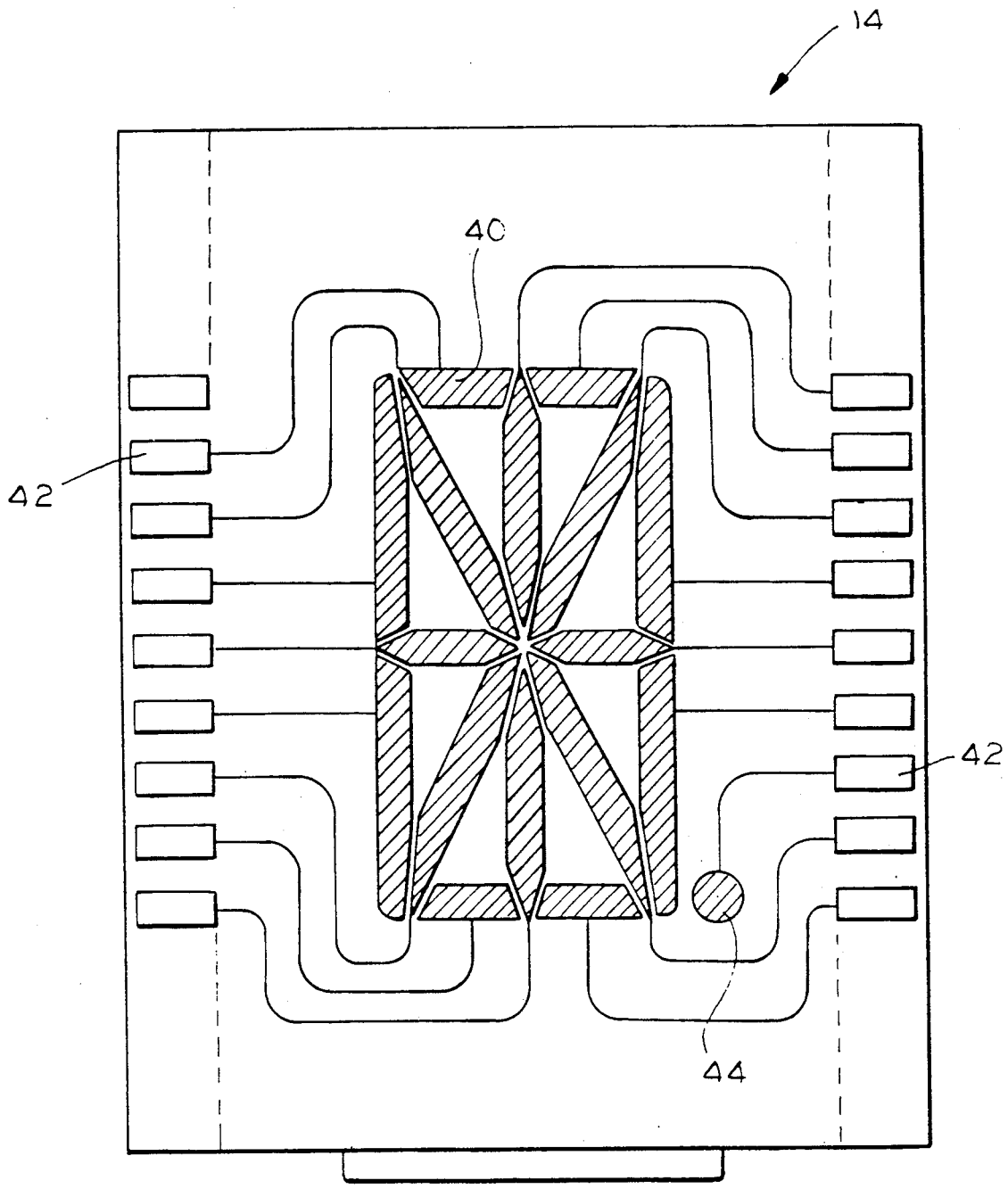
FIG. 3 is an electrical diagram of a liquid crystal display for the thumbwheel switch of FIG. 1.

The display 14 includes first and second glass sheets 36 and 38 sandwiching a liquid crystal display (LCD) circuit. In the illustrative embodiment of the invention, the display 14 comprises a sixteen-segment LCD, specifically illustrated in FIG. 3. The display 14 includes sixteen segments, referenced typically at 40, each electrically connected to a conductive connector pad 42. Also, a decimal point segment 44 is provided electrically connected to a similar conductive pad 42. The LCD display 14 operates in a conventional manner to display a character according to the voltage present at each of the pads 42.

First and second elastomer connectors 46 and 48 connect the LCD pads 42 to corresponding conductive pads 50 on a printed circuit board 52. The elastomer connectors 46 and 48 have alternating layers of conductive rubber 54 and insulating rubber 56. The elastomer connectors 46 and 48 also serve when the printed circuit board 52 is mounted in the housing 12 to hold the display 14 against the top wall central section 29 so that the character is displayed through the lens 34.

The pushbutton switches 16 and 18 each include a flange 58 and an actuator element 60. The pushbuttons 16 and 18 are formed of a flexible material and include a conductive contact (not shown) on the underside of the actuator element above the lower wall of the flange 58. The actuator elements of the pushbuttons 16 and 18 extend through the respective pushbutton openings 30 and 31. The contact for the up pushbutton 16 is thus positioned above first and second switch contacts 62 and 64 on the printed circuit board 52. Similarly, the contact for the down pushbutton 18 is positioned above third and fourth switch contacts 66 and 68 also on the printed circuit board 52.

If the actuator 60 for the up pushbutton 16 is depressed, then electrical contact is made between the first and second switch contacts 62 and 64; while if the actuator 60 for the down pushbutton 18 is depressed then electrical contact is made between the third and fourth switch contacts 66 and 68.

An integrated circuit 70 in die form is affixed to the printed circuit board 52. The integrated circuit 70 includes suitable connection points which connect via conductive traces referenced typically at 72 to the pads 50, the switch contacts 62, 64, 66 and 68 and to a plurality of terminal pins referenced typically at 74. The terminal pins 74 are connected to the traces 72 through apertures 76.

As in conventional chip-on-board applications, the integrated circuit 70 is wire bonded to the printed circuit board 52. Commercially available high purity chip-on-board encapsulant (not shown) can be used to seal and protect the integrated circuit 70 after wire bonding.

The terminal pins 74 are desirably of a length such that they can be inserted through the holes of a printed circuit board and soldered in place. The length of the pins 74 can be varied based on the mounting and connection requirements. After the pins 74 and the integrated circuit 70 are assembled to the printed circuit board 52, an encapsulant (not shown) such as an encapsulating epoxy for electronic devices, can be applied through the open bottom of the housing 12 to the printed circuit board 52 and around the terminals pins 74 in order to seal and provide rigid support for the printed circuit board 52 and the terminal pins 74. The physical orientation of the pins 74 is determined according to conventional requirements for twenty pin dual-in-line packages. However, as is evident, only sixteen pins are utilized in the exemplary embodiment. The pin connections are specified in accordance with the following Chart No. 1:

CHART NO. 1

| Pin Number | Pin Mnemonic |
|---|---|
| 1 | D0 |
| 2 | D2 |
| 3 | No connection |
| 4 | CLK |
| 5 | (Not Used) |
| 6 | (Not Used) |
| 7 | $\overline{WE}$ |
| 8 | $\overline{OE}$ |
| 9 | No connection |
| 10 | GND |
| 11 | D/H |
| 12 | $\overline{CE}$ |
| 13 | No connection |
| 14 | No connection |
| 15 | (Not Used) |
| 16 | (Not Used) |
| 17 | No connection |
| 18 | D3 |
| 19 | D1 |
| 20 | VCC |

The switch 10 can be used with a host processor or other external device and the switch 10 is operable to both read and write the count value from and to the data terminals DO–D3. Also, according to an alternative embodiment of the invention, as discussed below, the switch can display an ASCII character received at the data terminals.

The function performed by the various pin terminals is as described in the Chart No. 2, below.

CHART NO. 2

| Pin Mnemonic | Function |
|---|---|
| $\overline{CE}$ | Chip Enable Input |
| D/H | Dec/Hexadec select |
| $\overline{WE}$ | Read/Write Input |
| $\overline{OE}$ | Output Enable Input |
| D0–D3 | Data I/O |
| CLK | Clock Input |
| VCC | Power (+5V) |
| GND | Ground |

Figure 4:
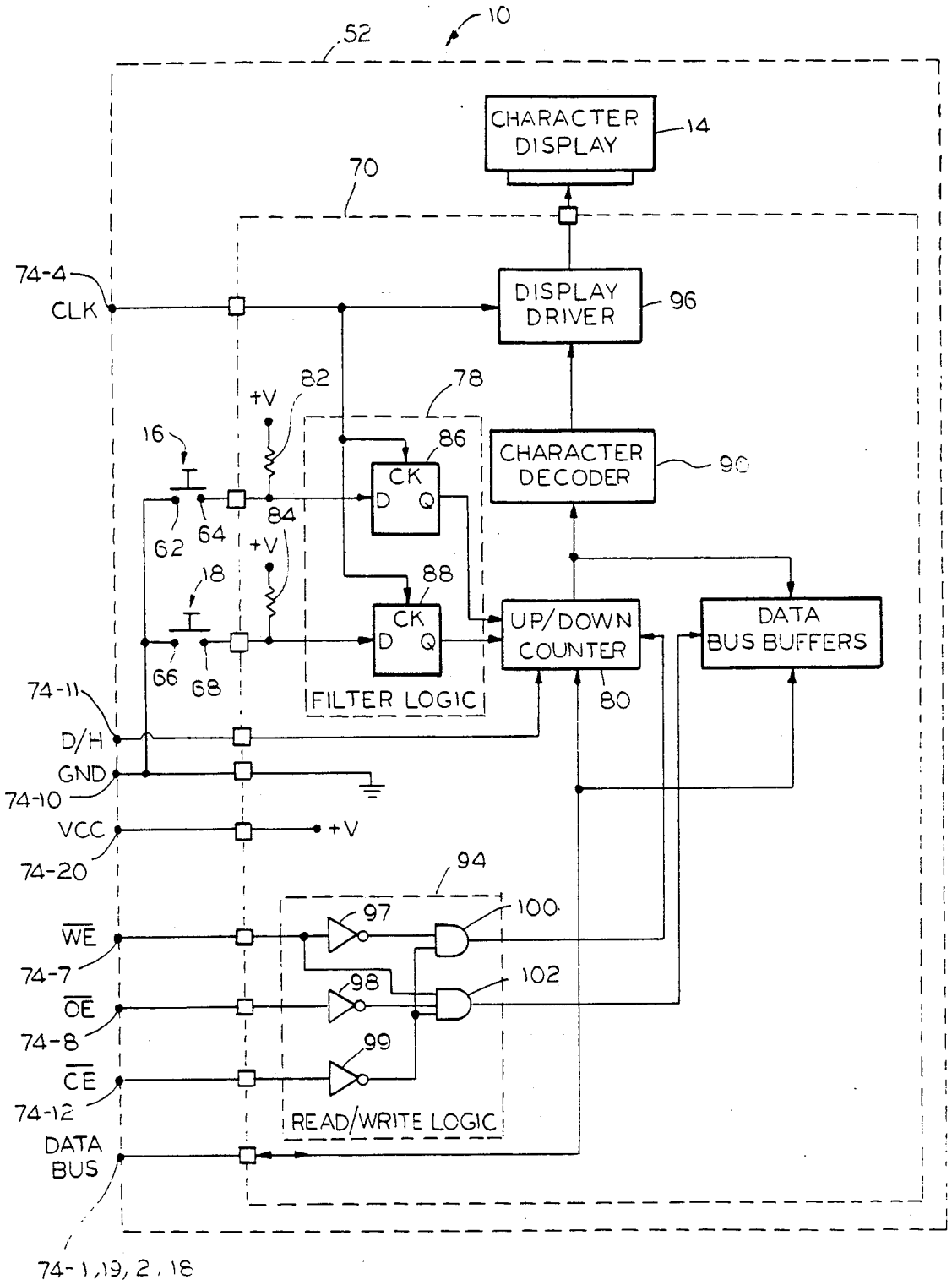
FIG. 4 is a generalized schematic and block diagram of the thumbwheel switch of FIG. 1 according to one aspect of the invention.

With reference now to FIG. 4, a schematic/block diagram for the integrated circuit 70 according to one embodiment of the invention is illustrated.

For simplicity, the circuit 70 is illustrated showing suitable connections to the particular terminal pins 74. The appropriate terminal pins 74 are referenced with a numeral comprising the reference numeral 74 followed by a suffix indicating the pin number along with the appropriate mnemonic therefore. For example, the CLK terminal at pin 4 is indicated with the reference numeral 74-4.

The integrated circuit 70 includes a filter logic circuit 78. The filter logic circuit 78 eliminates "switch bounce" which might otherwise cause multiple clocking of an up/down counter 80 during actuation of the up pushbutton 16 or the down pushbutton 18. As discussed above, actuating the up pushbutton 16 increments the up/down counter 80, while actuating the down pushbutton 18 decrements the up/down counter 80. First and second pullup resistors 82 and 84 are coupled from the plus voltage received at the VCC terminal pin 74-20 to the respective switch contacts 64 and 68. The switch contacts 62 and 66 for the respective pushbuttons 16 and 18 are connected to ground via the GND terminal pin 74-10.

The filter logic circuit 78 includes first and second D-type flip-flops 86 and 88 respectively. The D input for each of the flip-flops 86 and 88 is connected to the respective pullup resistors 82 and 84. A clock input of each of the flip-flops 86 and 88 is connected to the CLK terminal pin 74-4. Particularly, the clock period should be longer than any switch bounce that can occur, thereby eliminating such occurrence. The first flip-flop 86 provides a single clocking pulse to an up clock input of the up/down counter 80. Similarly, the second flip-flop 88 provides a single clocking pulse for each switch actuation of the down pushbutton 18 to the down clock input of the up/down counter 80.

The filter logic circuit 78 may be eliminated if alternate means are included for providing a single clocking pulse for each switch actuation of the pushbuttons 16 and 18.

The up/down counter 80 provides four stages, or bits, of counting for storing the count which represents the heel setting. The inputs consist of the up clock, the down clock, a load enable, a decimal/hexadecimal select and four individual JAM inputs. The counter 80 also includes four stages of output. An up clock input pulse increases the count by one. A down clock input pulse decreases the count by one. Counting occurs on the falling edge of either clock input. The status of the decimal/hexadecimal input received from the D/H terminal pin 74-11 determines the count wrap-around value. Particularly, for decimal the count increments from zero through nine and then back to zero; while for hexadecimal the count increments from zero through F and then back to zero. The four stages of output are from the four counter stages and reflect the current thumbwheel count, i.e., setting. These outputs are transferred to a character decoder 90 and to a data bus buffer 92. The four JAM inputs are received from the data bus, i.e., the D0–D3 terminal pins 74–1, 19, 2, 18. The thumbwheel count or setting is overwritten from the JAM inputs when the load enable input which is received from a read/write logic circuit 94 is in a high state. Particularly, the JAM inputs are utilized to preload the up/down counter 80 with a preset value from a host processor in suitable applications.

The data bus buffer 92 is utilized to permit the thumbwheel count to be read by a host processor. The data bus buffer 92 comprises four separate three-state buffers with a common enable input. The common enable input is driven from the read/write logic circuit 94. These four buffers drive the four least significant bits of the data bus with the four stages of output from the up/down counter 80 when enabled by the read/write logic circuit 94 during a read of the thumbwheel count. A high signal from the read/write logic circuit 94 to the common enable input enables a read of the thumbwheel count. A low signal at the common enable input disables the buffers such that their outputs are at a high impedance state.

The character decoder 90 decodes a binary coded character, such as BCD (binary coded decimal), hexadecimal or ASCII character, into the segments required for driving the character display 14. For example, in an exemplary embodiment wherein a seven-segment display is used, then a BCD-to-seven-segment decoder of conventional construction is utilized. Conversely, if a dot-matrix display is used, then the decoder is operable to decode each display dot based on the character which is to be displayed.

The decoded signal from the character decoder 90 is transferred to a display driver circuit 96 which generates the suitable drive signals to the character display 14. Particularly, the display driver 96 includes circuitry specific to the type of display utilized. For example, the signals would differ according to whether the display comprised a liquid crystal display or an LED display, as is well known. The display driver is clocked by the CLK input at terminal pin 74-4.

The read/write logic circuit 94 decodes read and write operations responsive to commands from a external source, such as a host processor. The read/write logic circuit includes three inverters 97–99 respectively coupled to the $\overline{WE}$ terminal pin 74-7, the $\overline{OE}$ terminal pin 74-8 and the $\overline{CE}$ terminal pin 74-12. The output of the first and third inverters 97 and 99 are coupled to a first AND gate 100. The output of the second and third inverters 98 and 99, and the terminal pin 74-7 are connected to a second AND gate 102. The output of the first AND gate 100 is connected to the load enable input of the up/down counter 80. The output of the second AND gate 102 is connected to the common enable input of the data bus buffer 92.

As discussed above, during a read operation the current thumbwheel count of the up/down counter 80 is transmitted to the data bus terminals D0–D3 by the data bus buffer circuit 92. During a write operation the thumbwheel count is overwritten with data from the data bus terminals D0–D3. The chip enable input $\overline{CE}$ at terminal pin 74-12 provides a device enable for read/write operations and is typically driven from a device or address decoder. The write enable input $\overline{WE}$ at terminal 74-7 is normally high and is pulsed low during a write operation and is typically driven by a host processor write enable signal. The output enable input $\overline{OE}$ at terminal pin 74-8 is normally high and is pulsed low during a read cycle and is typically driven by the host processor with an output enable or read enable signal.

If a device enable is present at the chip enable input $\overline{CE}$ and the write enable input $\overline{WE}$ is pulsed low, then the load enable signal at the up/down counter 80 goes high to overwrite the thumbwheel count with data from the data bus terminals D0–D3. Similarly, if the chip enable input $\overline{CE}$ enables operation and the output enable input terminal $\overline{OE}$ is pulsed low, and assuming that the write enable input $\overline{WE}$ remains high, then the common enable input of the data bus buffer circuit 92 goes high so that the thumbwheel count is transferred to the data bus terminals D0–D3.

Summarizing operation of the thumbwheel switch 10 according to the circuit embodiment illustrated in FIG. 4, each actuation of the up pushbutton 16 causes the thumbwheel count in the up/down counter 80 to increment by one which causes the character displayed at the character display 14 to be correspondingly incremented. Each actuation of the down pushbutton 18 causes the up/down counter thumbwheel count to decrement causing the character displayed at the character display 14 to decrement by one. If a write command is received from a host processor, then the data present at the data bus D0–D3 overwrites the thumbwheel count of the up/down counter 80 to provide a preloading of a specific character therein and at the character display 14.

Figure 5:
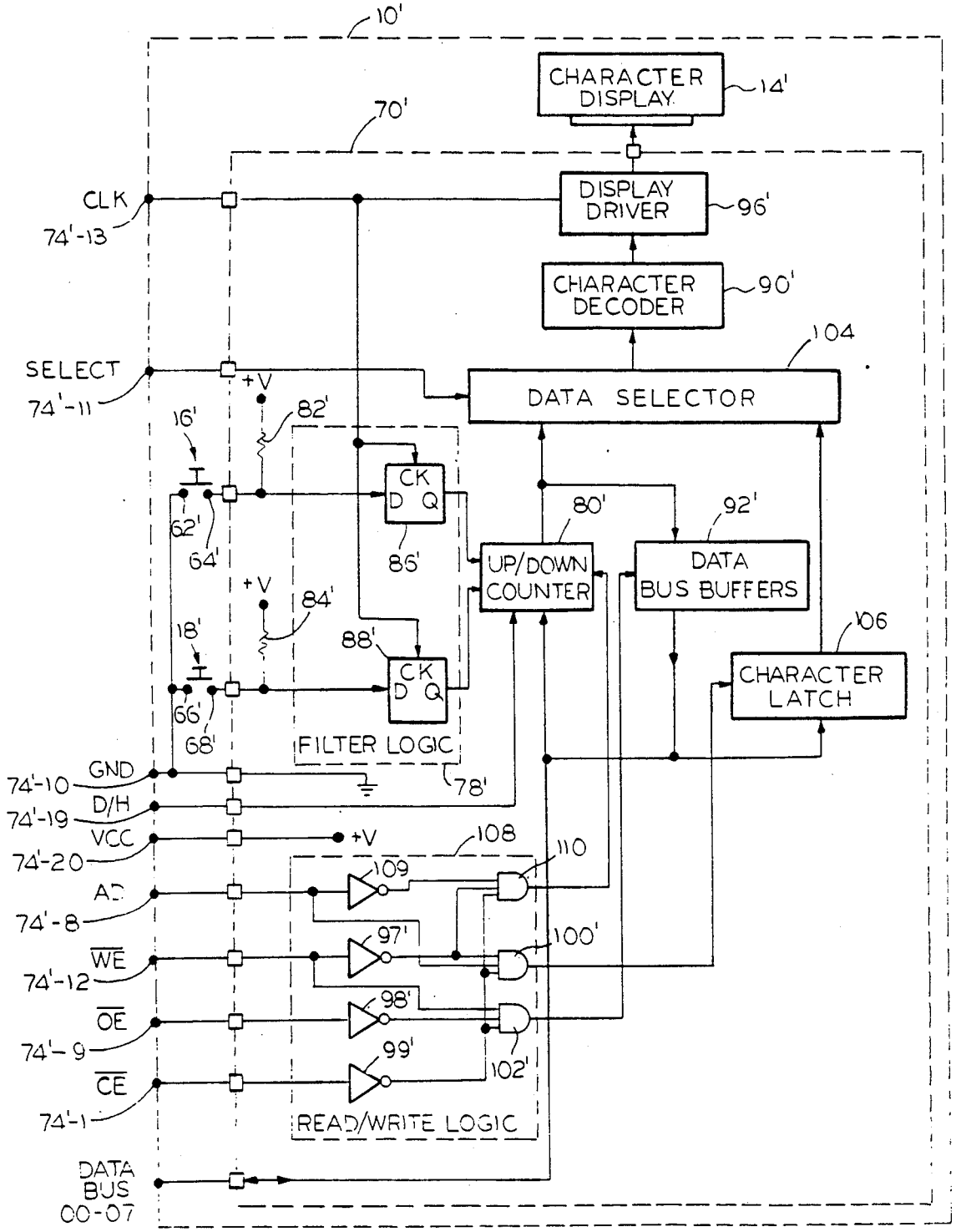
FIG. 5 is a generalized schematic/block diagram of a thumbwheel switch according to an alternative aspect of the invention including a character latch circuit.

Referring now to FIG. 5, a schematic/block diagram of an integrated circuit 70' according to an alternative embodiment of the invention is illustrated. Specifically, according to the alternative embodiment of the invention, a thumbwheel switch 10' includes means for substituting a text or other character for the thumbwheel count to be displayed on the display 14'. Such character may be used, for example, as part of a message to a user thereof.

The thumbwheel switch 10' is illustrated with like, primed reference numerals relative to elements corresponding to those elements discussed above relative to FIG. 4. Therefore such elements will not be described in detail relative to FIG. 5.

The integrated circuit 70' differs from the integrated circuit 70 of FIG. 4 in that it includes a data selector 104, a character latch 106 and an alternative read/write logic circuit 108. Also, the integrated circuit 70' is operable to interface with an eight bit data bus, although only seven bits are used.

The pin assignment for the thumbwheel switch 10' according to the alternative embodiment of the invention is as indicated in the following Chart No. 3:

CHART NO. 3

| Pin Number | Pin Mnemonic |
|---|---|
| 1 | $\overline{CE}$ |
| 2 | D6 |
| 3 | D4 |
| 4 | D2 |
| 5 | (Not Used) |
| 6 | (Not Used) |
| 7 | D0 |
| 8 | A0 |
| 9 | $\overline{OE}$ |
| 10 | GND |
| 11 | SELECT |
| 12 | $\overline{WE}$ |
| 13 | CLK |
| 14 | D1 |
| 15 | (Not Used) |
| 16 | (Not Used) |
| 17 | D3 |
| 18 | D5 |
| 19 | D/H |
| 20 | VCC |

The character latch circuit 106 provides seven bits of latched data for storing an ASCII character to be displayed on the character display 14'. The seven data inputs of the character latch circuit 106 are received from the data bus terminals D0–D6. The character latch circuit 106 includes a latch enable input from the read/-write logic circuit 108. When the latch enable input is high, a new character is loaded from the data bus terminals D0–D6, which is latched when the latch enable input goes low.

The seven bits of latched data from the character latch circuit 106 are provided as outputs to the data selector 104. The data selector also receives a four bit count setting from the up/down counter 80'. The data selector 104 is operable to select either the thumbwheel count from the up/down counter 80' or the stored character from the character latch 106 for transmission to the character decoder 90' and thus display at the character display 14'.

The data selector 104 comprises seven two-input multiplexers which select seven bits of data from one of the two input sources 80' or 106 under the control of a SELECT input at terminal pin 74'-11. Since the thumbwheel count value from the counter 80' uses only four bits, then the multiplexer inputs for the three extra bits are tied to ground. Once the source is selected, then the selected seven bits are transferred to the character decoder 90'.

The read/write logic circuit 108 differs from the logic circuit 94, see FIG. 4, in that it includes a fourth inverter 109 connected to the address select input AO at terminal pin 74'-8, and a third AND gate 110. The third AND gate 110 receives as inputs the outputs from the first, third and fourth inverters 97', 99' and 109, respectively. Also, the address select input A0 is coupled to the first AND gate 100'. The output of the first AND gate 100' is coupled to the latch enable input of the character latch 106. The output of the second AND gate 102' is coupled to the common enable input of the data bus buffer 92'. The output of the third AND gate 110 is coupled to the load enable input of the up/down counter 80'.

In order to write a new thumbwheel count from the data bus terminals D0–D6 to the up/down counter 80' the address select input A0 at terminal pin 74'-8 must be held low. To write a new text character the address select input AO must be held high.

The character decoder 90' differs from the character decoder 90 of FIG. 4 only in that it must be expanded to include means for decoding ASCII characters, as is well known. A typical scheme would use codes 20 through 7F hexadecimal for ASCII characters, codes 00 through OF for a hexadecimal thumbwheel and codes 00 through 09 for a BCD thumbwheel.

Figure 6:
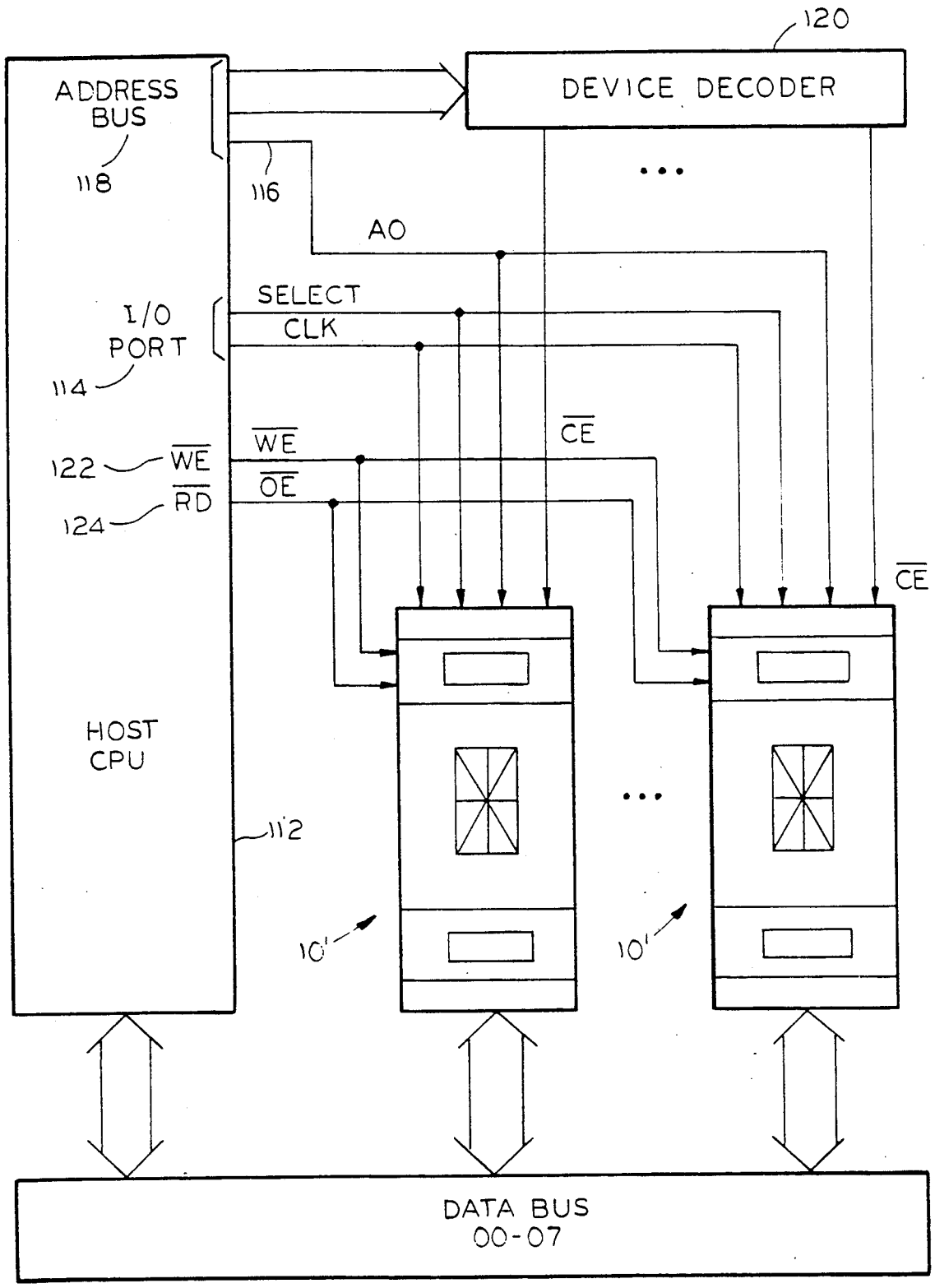
FIG. 6 is an electrical block diagram illustrating a typical application for a plurality of thumbwheel switches operable in a supervisory control system.

With reference to FIG. 6, a block diagram illustrates a typical application for a plurality of thumbwheel switches 10' in conjunction with a host CPU 112. The SELECT input and CLK input for each thumbwheel switch 10' are driven from an I/0 port 114 of the CPU 112. Alternatively, the CLK input could be driven from an internal or external oscillator (not shown). The address input A0 is driven by the least significant address line 116 of an address bus 118. The chip enable input $\overline{CE}$ for each thumbwheel switch 10' is driven by a device decoder 120 which is coupled to the address bus 118. The write enable input $\overline{WE}$ is driven by the host CPU 112 from the write enable output 122 which is active low. The output enable input $\overline{OE}$ for each thumbwheel switch 10' is driven by the host CPU 112 from a read enable output 124 which is active low.

Multiple electronic thumbwheel switches can be added by bussing all of the above-described signals with the exception of the chip enable input $\overline{CE}$ which provides device selection, such that each device can be accessed separately.

The use of the circuit embodiments described relative to FIGS. 4 and 5 in any application depend upon the required capabilities and economics of each application, as is apparent from the above.

Thus, the invention broadly comprehends an electronic thumbwheel switch which is adapted to be preloaded with a preselect value from an external source.

The foregoing disclosure of the alternative embodiments is illustrative of the broad inventive concepts comprehended by the invention.

I claim:

1. An electronic thumbwheel comprising:

means for storing a thumbwheel count value;

a display device coupled to the storing means for displaying the count value;

manual input means coupled to the storing means for selecting a desired count value to be displayed on the display device; and a data bus interface circuit for connection via a bidirectional data bus to an external control element and coupled to the storing means, the data bus interface circuit including writing means for writing an output to the data bus representing the stored count value, reading means for reading a count value received from the data bus into said storing means for display on said display device and means for selectively enabling at most one of said writing means or said reading means to control transfer of data between the data bus and said storing means.

2. The electronic thumbwheel of claim 1 wherein said manual input means comprises two pushbutton switches.

3. The electronic thumbwheel of claim 2 further comprising a filter circuit coupled between said pushbutton switches and said storing means.

4. The electronic thumbwheel of claim 1 wherein said storing means comprises an up/down counter.

5. The electronic thumbwheel of claim 4 wherein said up/down counter comprises a selectable decimal or hexadecimal counter and further comprising means coupled to said counter for selecting decimal or hexadecimal count operation.

6. The electronic thumbwheel of claim 1 wherein said data bus interface circuit comprises a data buffer circuit.

7. The electronic thumbwheel of claim 1 wherein said storing means comprises a preloadable counter and said reading means comprises logic means for enabling said counter to preload said count value with a value received from the data bus.

8. The electronic thumbwheel of claim 1 wherein said storing means is a first storing means and further comprising second storing means for storing a substitute character and means coupled to said first and said second storing means and said display device for selectively coupling one of said storing means to said display device to selectively display either the count value or the substitute character.

9. An electronic thumbwheel and display device comprising:

first storing means for storing a count value;

manual input means coupled to the first storing means for selecting a desired count value;

second storing means for storing a character value;

means coupled to said first and said second storing means for selecting said count value or said character value;

a display device coupled to the selecting means for displaying a symbol corresponding to the selected value; and a data bus interface circuit for connection via a data bus to an external control device and coupled to said first and second storing means, the data bus interface circuit including writing means for writing an output to the data bus representing the stored count value, first read enable means for reading data representing a count value received from the data bus into said first storing means, and second read enable means for reading data representing a character value received from the data bus into said second storing means.

10. The electronic thumbwheel and display device of claim 9 wherein said manual input means comprises two pushbutton switches.

11. The electronic thumbwheel and display device of claim 10 further comprising a filter circuit coupled between said pushbutton switches and said first storing means

12. The electronic thumbwheel and display device of claim 9 wherein said first storing means comprises an up/down counter.

13. The electronic thumbwheel and display device of claim 12 wherein said up/down counter comprises a selectable decimal or hexadecimal counter and further comprising means coupled to said counter for selecting decimal or hexadecimal count operation.

14. The electronic thumbwheel and display device of claim 9 wherein said data bus interface circuit comprises a data buffer circuit.

15. The electronic thumbwheel and display device of claim 9 wherein said first storing means comprises a preloadable counter and said first read enable means comprises logic means for enabling said counter to preload said count value with a value received from the data bus.

16. The electronic thumbwheel and display device of claim 9 wherein said second storing means comprises a character latch circuit.

17. A multi-character input and display system for use in a host CPU system including a host processor, a data bus for bidirectional transmission of data to and from said processor, an address bus for transferring device address select information, a device decoder for decoding said address information, and a control bus for controlling selection of input and output data to and from said processor, comprising:

a plurality of electronic thumbwheels disposed in proximity to one another, each thumbwheel including means for storing a thumbwheel count value, a display device coupled to the storing means for displaying the count value, manual input means coupled to the storing means for selecting a desired count value to be displayed on the display device, a data bus interface circuit for connection a bidirectional data bus to an external control element and coupled to the storing means, the data bus interface circuit including writing means for writing an output to the data bus representing the stored count value, reading means for reading a count value received from the data bus into said storing means for display on said display device, and logic means for connection to said device decoder and said control bus for selectively enabling at most one of said writing means or said reading means to control transfer of data between the data bus and the storing means.

18. A multi-character input and character display system for connection to a host CPU system including a host processor, a data bus for bidirectional transmission of data to and from said processor, an address bus for transferring device address select information, a device decoder for decoding said address information, and a control bus for controlling selection of input and output data to and from said processor, comprising:

a plurality of electronic thumbwheels disposed in proximity to one another, each thumbwheel including first storing means for storing a count value, manual input means coupled to the first storing means for selecting a desired count value, second storing means for storing a character value, means coupled to said first and second second storing means for selecting said count value or said character value, a display device coupled to the selecting means for displaying a symbol corresponding to the selected value, and a data bus interface circuit for connection via a data bus to an external control device and coupled to said first and second storing means, the data bus interface circuit including writing means for writing an output to the data bus representing the stored count value, first read enable means for reading data representing a count value received from the data bus into said first storing means, and second read enable means for reading data representing a character value received from the data bus into said second storing means, and means for selectively enabling at most one of said writing means, said first read enable means or said second read enable means, to control transfer of data between the data bus and said first and second storing means.

* * * * *